US008094011B2

(12) United States Patent
Faris et al.

(10) Patent No.: US 8,094,011 B2
(45) Date of Patent: Jan. 10, 2012

(54) TRANSCEIVER DEVICE FOR CELL PHONES FOR TRACKING OF OBJECTS

(76) Inventors: Everardo Dos Santos Faris, Avenida Govenador Roberto Siliveira (BR); Paulo Luz Teixeira, Jr., Delray Beach, FL (US); Marcos Batista Correa, Avenida Govenador Roberto Siliveira (BR)

( * ) Notice: Subject to any disclaimer, the term of this patent is extended or adjusted under 35 U.S.C. 154(b) by 540 days.

(21) Appl. No.: 12/315,560

(22) Filed: Dec. 4, 2008

(65) Prior Publication Data

US 2010/0039266 A1 Feb. 18, 2010

(51) Int. Cl.
*G08B 1/08* (2006.01)

(52) U.S. Cl. ..... 340/539.13; 340/539.21; 340/568.1

(58) Field of Classification Search ..... 340/539.13, 340/539.21, 568.1, 539.32, 572.1, 573.4, 340/539.23, 686.6
See application file for complete search history.

(56) References Cited

U.S. PATENT DOCUMENTS 6,570,504 B2 * 5/2003 Rabanne et al. ..... 340/573.4
2005/0134459 A1 * 6/2005 Glick et al. ..... 340/572.1
2006/0038676 A1 * 2/2006 Richards ..... 340/539.23
2007/0001803 A1 * 1/2007 Plamoottil ..... 340/2.1
2008/0136642 A1 * 6/2008 Wise ..... 340/572.1
2009/0040048 A1 * 2/2009 Locker et al. ..... 340/572.1
2010/0097237 A1 * 4/2010 Christiansen ..... 340/686.6
2010/0164715 A1 * 7/2010 Buller et al. ..... 340/539.32
2010/0178913 A1 * 7/2010 Herbert et al. ..... 340/568.1
2010/0259389 A1 * 10/2010 Marshall ..... 340/572.1

* cited by examiner

*Primary Examiner* — John A Tweel, Jr.
(74) *Attorney, Agent, or Firm* — Robert M. Downey, P.A.

(57) ABSTRACT

A system for tracking objects includes a radio frequency (RF) transceiver device integrated in a wireless handheld personal electronic device (e.g., cell phone, BLACKBERRY, iPHONE) having a visual display, a battery power source and a selection of distinct audible ringtones. The transceiver device communicates via RF signals with transponders installed within or attached to personal objects such as, but not limited to: keys; wallets; laptops; handbags; handheld electronic devices; cameras; video cameras; MP3 players; sunglasses and pens. The tracked objects are programed into the wireless handheld electronic device and are viewable on the display, identifying the object by name, transponder number and identifying ringtone. The transceiver device is preprogramed to trigger alarm functions (e.g., distinct ringtone, vibration and/or visual indicator) of the wireless handheld device upon any one or more of the tracked objects becoming separated from the transceiver device beyond a predetermined distance.

3 Claims, 3 Drawing Sheets

TRANSCEIVER DEVICE FOR CELL PHONES FOR TRACKING OF OBJECTS

BACKGROUND OF THE INVENTION

1. Field of the Invention

The present invention relates to systems for tracking objects and, more particularly, to an RF transceiver device integrated in a wireless handheld personal electronic device for tracking one or more objects by communicating with transponders attached to the one or more objects.

2. Discussion of the Related Art

Most people carry several valuable objects with them as they go through their daily routine. For instance, a typical person may carry a wireless communication device (e.g., cellular phone, BLACKBERRY, iPHONE), a wallet or purse, keys (e.g., car keys, house keys and various other keys on a keychain), a laptop computer or handheld PC, an MP3 player and sunglasses. Understandably, it is not always easy to remember to bring all of these items when leaving home. Furthermore, it can be very difficult to keep track of each of these items as a person moves from one location to another during their daily travels. If a person realizes that they have forgotten one or more valuable items shortly after leaving a particular location, they may have an opportunity to quickly return and retrieve their personal property. Unfortunately, in many instances valuables such as wallets and electronic devices are often stolen if left unguarded even for a short amount of time. In other instances, such as when traveling on a train or airplane, valuables that are left behind are rarely retrieved by their owner. In the best case scenario, it can be a terrible inconvenience when a person accidentally forgets their keys, wallet, or other personal items when leaving their home, automobile, work place or a public location.

Accordingly, there remains an urgent need for a personal object tracking system that can be easily integrated into commonly used wireless handheld communication devices (e.g., cell phones, BLACKBERRY, iPHONE) that will instantly alert a person when one or more of their personal items becomes separated from them beyond a predetermined limited distance (e.g., 1-3 meters).

OBJECTS AND ADVANTAGES OF THE INVENTION

Considering the foregoing, it is a primary object of the present invention to provide a system integrated as a function of a wireless handheld personal electronic device, such as a cellular phone, BLACKBERRY, or iPHONE for tracking personal objects so that they are not forgotten, misplaced or stolen.

It is a further object of the present invention to provide a tracking system that is integrated with the functions of a wireless handheld personal electronic device for tracking items of personal property including, but not limited to: keys, wallets, laptops, handbags, handheld PCs, cameras, video cameras, cellular phones, MP3 players, sunglasses and pens, and wherein each of the tracked personal items are programmed and displayed on the wireless handheld personal electronic device.

It is still a further object of the present invention to provide a system for tracking items of personal property, and wherein the system includes a radio frequency (RF) transceiver device integrated in a wireless handheld personal electronic device (e.g., cell phone, BLACKBERRY, iPHONE), and further wherein individual transponders are fitted to each of the tracked personal items for communicating with the transceiver via RF signals.

It is still a further object of the present invention to provide a system for tracking items of personal property, and wherein the system includes an RF transceiver integrated into a wireless handheld personal electronic device having a visual display, a battery source, and a configuration menu for selecting polyphonic ringtones and/or vibration for alerting the user when any one or more of the tracked personal items becomes separated from the transceiver device (i.e., within the wireless handheld personal electronic device) beyond a predetermined minimal distance.

It is still a further object of the present invention to provide an RF transceiver tracking system integrated within a wireless handheld personal electronic device, and wherein each item being tracked is programmed and identified on the display of the wireless handheld personal electronic device, identifying each tracked item by name, transponder number and distinct ringtone.

It is still a further object of the present invention to provide an RF transceiver tracking system for tracking items of personal property, and wherein the tracking system is integrated within a wireless handheld personal electronic device, such as a cellular phone, BLACKBERRY, or iPHONE which already has the prerequisite energy source (i.e., battery), types of sound (i.e., ringtones), and visual display screen for communicating with the user, thereby allowing the wireless handheld electronic device to track the user's several items of personal property in a centralized manner.

It is still a further object of the present invention to provide a system for tracking one or more items of personal property, and wherein the system is integrated within a wireless handheld electronic device, and further wherein the system uses RF transceiver and transponder technology that has been proven to be effective for short range communication between two or more objects.

These and other objects and advantages of the present invention are more readily apparent with reference to the following drawings and detailed description.

SUMMARY OF THE INVENTION

The present invention is directed to a system for tracking objects and includes a radio frequency (RF) transceiver device integrated in a wireless handheld personal electronic device (e.g., cell phone, BLACKBERRY, iPHONE) having a visual display, a battery power source and a selection of distinct audible ringtones. The transceiver device communicates via RF signals with transponders installed within or attached to personal objects such as, but not limited to: keys; wallets; laptops; handbags; handheld electronic devices; cameras; video cameras; MP3 players; sunglasses and pens. The several transponders can be embedded in tags, adhesive labels or other flat and thin devices for installation within or attachment to the various objects being tracked. Each transponder communicates with the transceiver device on a specific RF frequency. The tracked objects are programmed into the wireless handheld electronic device and are viewable on the display, identifying the object by name, transponder number and identifying ringtone. The transceiver device is preprogrammed to trigger alarm functions (e.g., distinct ringtone, vibration and/or visual indicator) of the wireless handheld device upon any one or more of the tracked objects becoming separated from the transceiver device beyond a predetermined distance, thereby alerting the user if one or more of the tracked objects are inadvertently left behind when the user begins to leave a location.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
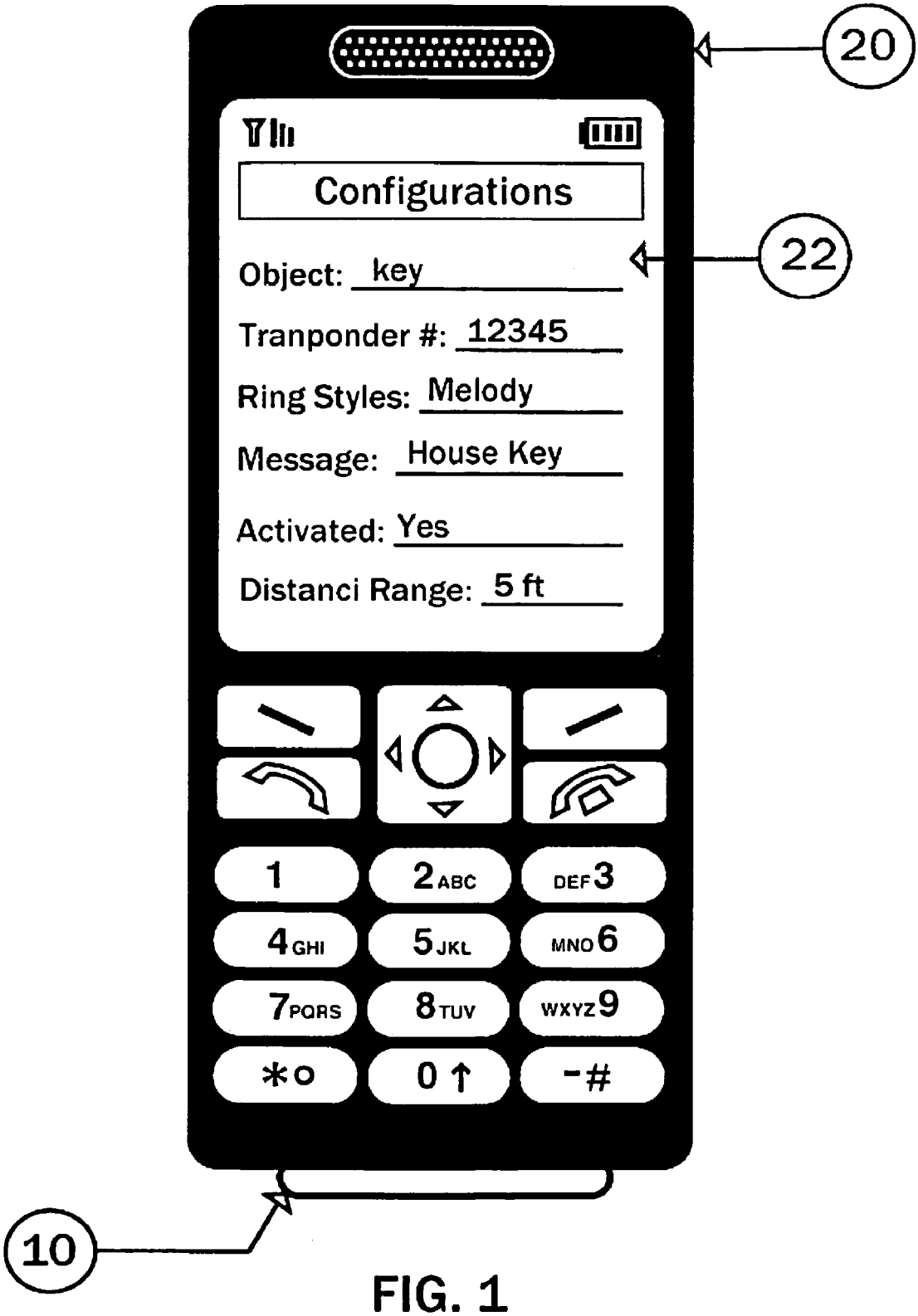
FIG. 1 is a front elevational view of a typical cellular telephone having a visual display, a plurality of buttons for dialing and programming, a battery power source, polyphonic ringtone storage, programming, and selection capabilities, a vibration alert mode, an RF transceiver fitted to a bottom of the cell phone, and wherein the display is shown indicating the tracking identification information for the user's house key.

The system for tracking objects is shown throughout the several views of the drawings and includes a radio frequency (RF) transceiver device 10 that is attached to or integrated within the circuitry of a wireless handheld personal electronic device 20, such as a cell phone, BLACKBERRY, iPHONE, etc. The wireless personal electronic device 20 is of well known design and includes an LCD display 22, or other similar type of visual display. The cell phone 20 further includes an arrangement of buttons for dialing numbers and for programming and selecting menu functions that are presented on the display 22. An internal battery (not shown) supplies power to the cell phone circuitry, including the RF transceiver device 10, as well as for powering all cell phone functions (e.g., audible ringtones, backlit display, vibration, etc.). The RF transceiver device 10 is structured and disposed to transmit and receive RF signals throughout a predetermined frequency range in accordance with well known short range RF transceiver and transponder technology. More particularly, the RF transceiver 10 is adapted to communicate with multiple transponders 30*a*-30*e*, with each transponder communicating with the transceiver device 10 on a specific radio frequency. The RF transceiver device 10 is able to identify each transponder 30*a*-30*e* based on the specific radio frequency emitted by each transponder. Each transponder is assigned a number or code for identification purposes. The transceiver device 10 is further adapted to determine the distance between the transceiver device 10 and each of the individual transponders throughout radio frequency communication. This may be achieved by evaluating RF signal strength or by elapsed time between the transmission of an RF signal from the transceiver device 10 and receipt of a return RF signal from each individual transponder 30*a*-30*e*. Other means for determining the distance between each individual transponder and the transceiver device can be employed, including well known methods available in existing transceiver and transponder communication technology.

The transceiver device 10 is preprogrammed to trigger an alarm condition upon detecting one or more of the transponders 30*a*-30*e* moving outside of a predetermined range relative to the transceiver device, and the wireless handheld electronic device. The RF transceiver device 10 is integrated with and/or communicates with the circuitry of the wireless electronic device 20 (e.g., cell phone, BLACKBERRY, iPHONE, etc.) enabling use of the battery power source, polyphonic ringtones, the display screen, menu presentations, programming, vibration mode and other features and functions of the wireless handheld electronic device 20 in the operation of the tracking system of the present invention. The plurality of transponders 30*a*-30*e* are affixed to particular objects or items of the user. Examples of personal items that may be tracked using the transceiver and transponder system of the present invention include, but are not limited to: keys; wallets; purses; laptop computers; handbags; luggage; handheld PCs; cameras; video cameras; cellular phones; MP3 players; sunglasses and pens.

Figure 2:
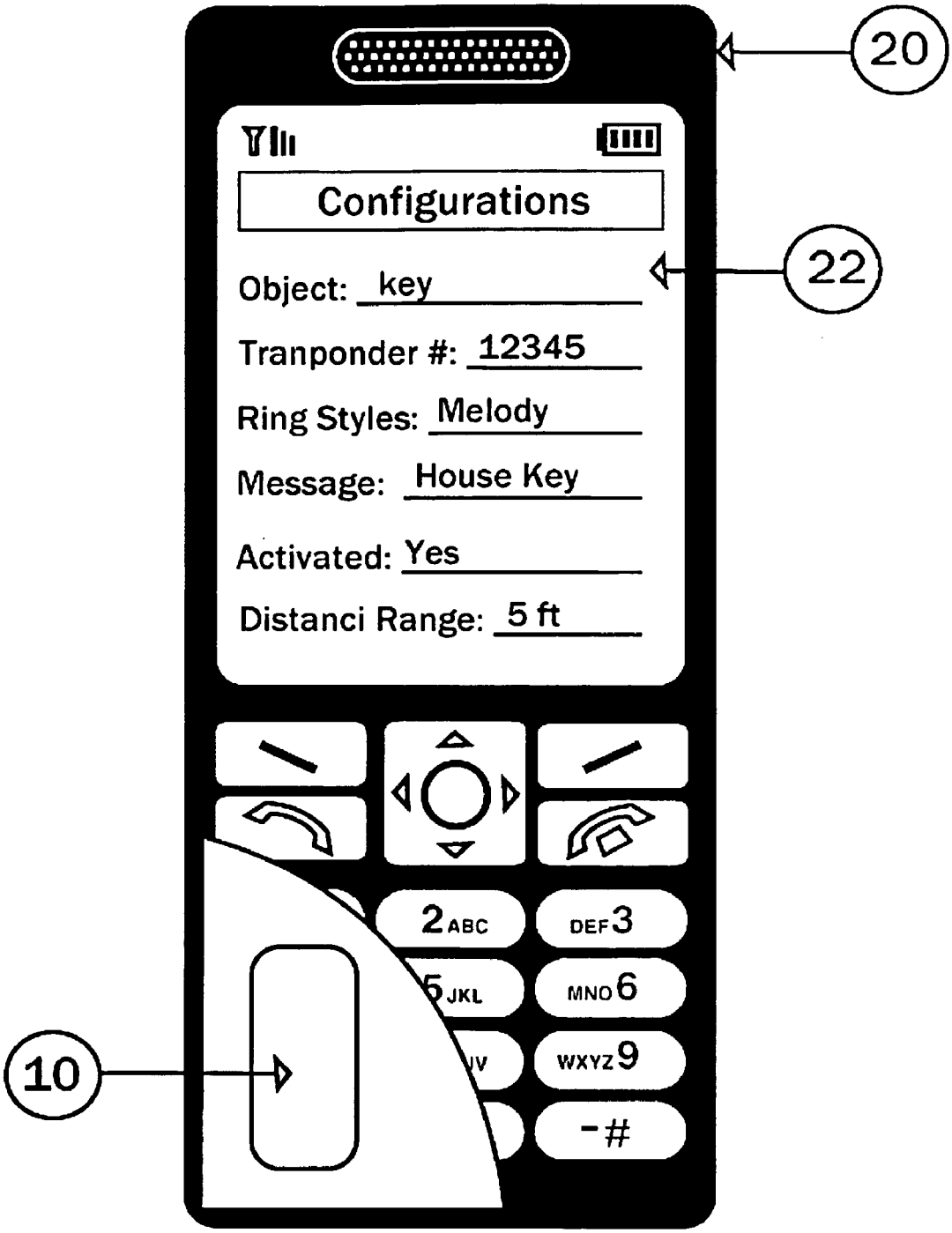
FIG. 2 is a front elevational view showing a typical cellular phone displaying the same object tracking information as in FIG. 1, and wherein the RF transceiver is fitted to a carry case or holster that holds the cell phone.
Figure 3:
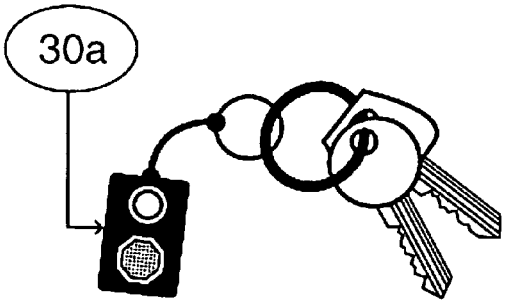
FIG. 3 is a perspective view showing keys carried on a key ring and having a tag attached with an embedded transponder for communicating with the transceiver in the cell phone of FIGS. 1 and 2.
Figure 4:
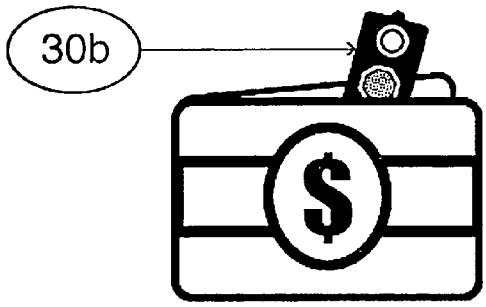
FIG. 4 is a perspective view showing a wallet carrying a transponder for communicating with the transceiver in the cell phone.
Figure 5:
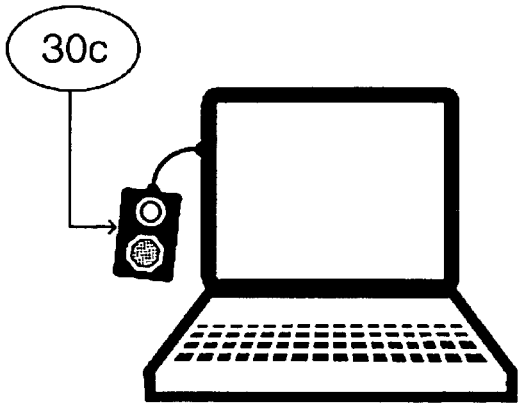
FIG. 5 is a front perspective view of a laptop computer shown with a tag attached that is embedded with a transponder for communicating with the transceiver in the cell phone.
Figure 6:
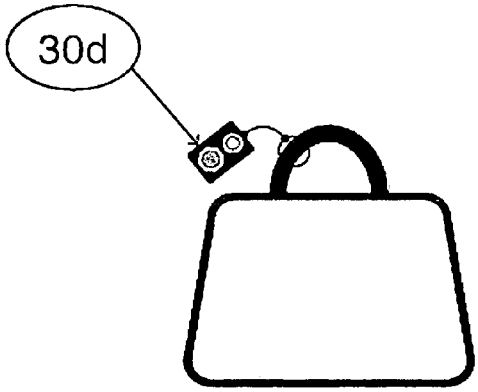
FIG. 6 is a side elevational view of a handbag shown with a tag attached, and wherein the tag is embedded with a transponder for communicating with the transceiver in the cell phone.
Figure 7:
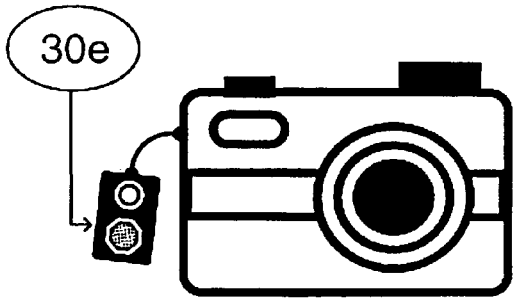
FIG. 7 is a front elevational view of a camera shown with a tag attached, and wherein the tag is embedded with a transponder for communicating with the transceiver in the cell phone.

FIGS. 3-7 show various examples of personal items that are tracked by the system of the present invention, using the cell phone shown in FIGS. 1 and 2. Specifically, each of the personal items shown in Figures in 3-7 are fitted with a transponder. The transponder may be embedded or attached to a tag that is secured to the personal item. Alternatively, the transponder may be embedded within the personal item or affixed by use of an adhesive label. Each transponder (30*a*-30*e*) is provided with a transponder identification number or code. The user programs each personal item into their cell phone or other personal electronic device 20 that has the integrated RF transceiver device 10. Each personal item is identified on the display by object name, the transponder number or code associated with the transponder that is attached to that particular personal item, a distinct ringtone for identifying the specific personal item, a message that more specifically describes the personal item and activation status. These items are displayed on the display of the cell phone, under the "Configurations" menu, as shown in FIGS. 1 and 2. If the user desires to leave one or more of the personal items home, or is simply not going to carry that particular item, they can access the "Configurations" menu and change the activated status to "no" for that particular item. In the event any one or more of these personal items under activation status "yes" becomes separated from the cell phone 20 beyond the preprogrammed maximum distance (e.g., 1-3 meters), the RF transceiver device 20 triggers activation of selected alarm modes, including activation of the distinct ringtone associated with that particular object and/or activation of the cell phone vibration function. The identification information for that particular item that has now moved outside of the predetermined range is shown on the display 22 of the cell phone 20. Additionally, each transponder (30*a*-30*e*) may be equipped with a sound and/or light emitting alarm device that is activated when the transponder becomes separated from the cell phone 20 beyond the preprogrammed maximum distance. Accordingly, the user is instantly alerted to the fact that a particular item of their personal property has ventured beyond the acceptable range, thereby allowing the owner to take immediate action to recover or retrieve the particular item of personal property. This rapid alert avoids the loss or theft of valuable personal property carried by the user. In the event the user accidentally leaves a location without the wireless handheld electronic device 20 (e.g., cell phone, BLACKBERRY, iPHONE, etc), the separation between the RF transceiver device 10 in the wireless electronic device 20 and the transponders 30*a*-30*e* which are carried by the user will cause an audible alarm to sound (e.g., a distinct ringtone) from the wireless handheld electronic device 20, thereby quickly alerting the user to retrieve their wireless personal handheld electronic device 20.

While the present invention has been shown and described in accordance with a preferred and practical embodiment, it is recognized that departures from the instant disclosure are fully contemplated within the spirit and scope of the present invention which, therefore, is not to be limited except as defined in the following claims as interpreted under the Doctrine of Equivalence.

What is claimed is:

1. A system for tracking objects comprising:

a wireless handheld personal electronic device having a battery power source, a visual display and programmable circuitry;

a transceiver device integrated with the circuitry of the wireless handheld electronic device, and said transceiver device being structured and disposed for sending and receiving radio frequency signals throughout a predetermined frequency range;

a plurality of transponders each being structured and disposed for receiving radio frequency signals from said transceiver device and for sending responsive radio frequency signals to said transceiver device at a specific radio frequency, thereby allowing said transceiver device to identify each of said plurality of transponders according to the specific frequency of the radio frequency signals transmitted by each of said plurality of transponders;

a plurality of attachment devices for attaching each of said plurality of transponders to a particular object to be tracked by the system;

an identifying code assigned to each of said plurality of transponders;

said wireless handheld personal electronic device being structured and disposed for storing and playing a plurality of distinct audible alarm tones, and one of said plurality of distinct audible alarm tones being assigned to each of said plurality of transponders;

said transceiver device being structured and disposed for determining and monitoring a distance between said transceiver device and each of said plurality of transponders, and said transceiver device being further structured and disposed to trigger an alarm mode of the wireless handheld electronic device upon detecting one or more of said plurality of transponders being separated from said transceiver device beyond a predetermined distance; and wherein the wireless handheld electronic device is structured and disposed to be programmed to associate each of said plurality of transponders with the particular object being tracked and the specific alarm tone and identifying code assigned to the particular object, and the wireless handheld electronic device being structured and disposed to display a description of the object being tracked along with the transponder identifying code and the specific alarm tone on the visual display, and the wireless personal electronic device being further structured and disposed to sound the distinct alarm tone associated with the object being tracked upon said transceiver device triggering the alarm function.

2. The system as recited in claim 1 wherein said wireless handheld personal electronic device is a cell phone.

3. The system as recited in claim 2 wherein said plurality of distinct audible alarm tones are ringtones.

* * * * *